US011713626B2

(12) United States Patent
Cochran et al.

(10) Patent No.: US 11,713,626 B2
(45) Date of Patent: Aug. 1, 2023

(54) SPOOLABLE SPLICE CONNECTOR AND METHOD FOR TUBING ENCAPSULATED CABLE

(71) Applicant: Schlumberger Technology Corporation, Sugar Land, TX (US)

(72) Inventors: Jamie Cochran, Inverurie (GB); Richard McCann, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/416,129

(22) Filed: May 17, 2019

(65) Prior Publication Data

US 2019/0271196 A1 Sep. 5, 2019

Related U.S. Application Data

(63) Continuation of application No. PCT/GB2017/053474, filed on Nov. 17, 2017.

(Continued)

(51) Int. Cl.
*E21B 17/02* (2006.01)
*E21B 17/00* (2006.01)

(Continued)

(52) U.S. Cl.
CPC ..... *E21B 17/046* (2013.01); *E21B 17/003* (2013.01); *E21B 17/206* (2013.01);

(Continued)

(58) Field of Classification Search
CPC .... E21B 17/028; E21B 17/003; E21B 17/046; E21B 17/206; E21B 43/128; E21B 19/008; E21B 34/02
See application file for complete search history.

(56) References Cited

U.S. PATENT DOCUMENTS 4,204,739 A * 5/1980 Shoenleben ..... E21B 17/028 439/805
4,490,065 A * 12/1984 Ullrich ..... F16B 5/02 403/379.3

(Continued)

FOREIGN PATENT DOCUMENTS

| | | |
|---|---|---|
| EP | 0419470 B1 | 2/1993 |
| JP | 2009 041701 A | 2/2009 |
| RU | 129588 U1 | 6/2013 |

OTHER PUBLICATIONS

Examination Report—European Patent Application No. 17 811 681.0-1002 dated May 8, 2020.

(Continued)

*Primary Examiner* — Robert E Fuller
*Assistant Examiner* — Neel Girish Patel
(74) *Attorney, Agent, or Firm* — Jeffrey D. Frantz

(57) ABSTRACT

A splice connector for a spoolable tube includes a center portion having an outer diameter equal to an outer diameter of the tube. A longitudinal extension extends in each longitudinal direction outwardly from the center portion. The longitudinal extensions have a plurality of spaced apart segments having an outer diameter equal to an inner diameter of the tube and a plurality of longitudinally spaced apart crimp grooves disposed between the spaced apart segments. An inner diameter of the splice connector is selected such that when the splice connector is assembled to the tube on each longitudinal extension, the splice connector is bendable to a radius of curvature of a winch reel used to deploy the tube into a wellbore.

8 Claims, 8 Drawing Sheets

Related U.S. Application Data

(60) Provisional application No. 62/423,310, filed on Nov. 17, 2016.

(51) Int. Cl.

| | |
|---|---|
| ***E21B 43/12*** | (2006.01) |
| ***H01R 4/18*** | (2006.01) |
| ***H01R 4/20*** | (2006.01) |
| ***E21B 17/20*** | (2006.01) |
| ***E21B 17/046*** | (2006.01) |
| ***E21B 19/00*** | (2006.01) |
| ***E21B 34/02*** | (2006.01) |

(52) U.S. Cl.
CPC ..... *E21B 34/02* (2013.01); *E21B 43/128* (2013.01); *H01R 4/183* (2013.01); *H01R 4/20* (2013.01); *E21B 19/008* (2013.01)

(56) References Cited

U.S. PATENT DOCUMENTS 4,572,299 A * 2/1986 Vanegmond ..... E21B 36/04 166/302
4,817,716 A * 4/1989 Taylor ..... E21B 29/12 166/207
4,869,319 A * 9/1989 Szymozak ..... F16L 13/166 285/123.6
6,009,216 A * 12/1999 Pruett ..... E21B 47/135 385/12
6,328,111 B1 12/2001 Bearden et al.
6,332,499 B1 * 12/2001 Kobylinski ..... E21B 17/028 166/242.6
6,419,278 B1 * 7/2002 Cunningham ..... F16L 33/2071 285/256
7,648,179 B2 * 1/2010 Webb ..... F16L 13/141 285/397
8,875,791 B2 * 11/2014 Erkol ..... E21B 19/22 166/242.6
2006/0243453 A1 11/2006 McKee
2007/0000669 A1 * 1/2007 McKee ..... E21B 17/041 166/242.6
2007/0235198 A1 * 10/2007 Parker ..... E21B 17/046 166/380
2008/0026623 A1 * 1/2008 Emerson ..... H01R 13/59 439/275
2008/0066905 A1 * 3/2008 Aivalis ..... E21B 23/14 166/250.01
2008/0073085 A1 * 3/2008 Lovell ..... E21B 19/22 166/380
2008/0169094 A1 * 7/2008 Ehtesham ..... E21B 17/046 166/242.6
2008/0169650 A1 * 7/2008 Webb ..... E21B 17/04 285/382.1
2008/0197624 A1 8/2008 Nakano et al.
2009/0066535 A1 * 3/2009 Patel ..... E21B 41/0035 340/853.2
2010/0193200 A1 * 8/2010 Rioufol ..... E21B 33/134 166/387
2010/0319931 A1 * 12/2010 Alff ..... E21B 17/02 166/85.1
2011/0000683 A1 * 1/2011 Denoix ..... E21B 17/023 166/385
2013/0309888 A1 * 11/2013 Nicholson ..... E21B 36/00 439/271
2016/0186507 A1 * 6/2016 Varkey ..... E21B 19/08 166/250.01
2017/0342782 A1 * 11/2017 Livescu ..... E21B 17/206
2017/0350198 A1 * 12/2017 Ma ..... E21B 17/028
2018/0323587 A1 * 11/2018 O'Grady ..... E21B 43/128

OTHER PUBLICATIONS

Examination Report—Gulf Cooperation Council Application No. GC 2017-34286 dated Mar. 12, 2020.
Examination Report—Gulf Cooperation Council Application No. GC 2017-34286 dated Apr. 30, 2019.
Ehtesham et al:, "Extending Life and Usage of CT Strings by High Performance Spoolable Connector", International Petroleum Technology Conference~Kuala Lumpur~Malaysia~Dec. 3, 2008.
International Search Report and Written Opinion, International Application No. PCT/GB2017/053474 dated Feb. 2, 2018..
Translation of First Office Action, dated Jul. 3, 2020 for Chinese Application No. 2017800698316.
Russian Office Action, dated Nov. 20, 2020 for Russian Application No. 2019117881/03(034206).
Translation of Russian Office Action, dated Nov. 20, 2020 for Russian Application No. 2019117881/03(034206).
Russian Search Report, dated Nov. 17, 2020 for Russian Application No. 2019117881/03(034206).
Second Office Action dated May 8, 2021, for Chinese Patent Application No. 2017800698316.
Translation of Second Office Action text, for Chinese Patent Application No. 2017800698316.
Third Office Action dated Nov. 2, 2021, for Chinese Patent Application No. 2017800698316.
Translation of Third Office Action text, for Chinese Patent Application No. 2017800698316.
Communication pursuant to Article 94(3) EPC dated Oct. 18, 2021, for European Patent Application 17811681.0.

* cited by examiner

SPOOLABLE SPLICE CONNECTOR AND METHOD FOR TUBING ENCAPSULATED CABLE

CROSS-REFERENCE TO RELATED APPLICATIONS

Continuation of International Application No. PCT/GB2017/053474 filed on Nov. 17, 2017. Priority is claimed from U.S. Provisional Application No. 62/423,310 filed on Nov. 17, 2016. Both the foregoing applications are incorporated herein by reference in their entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

This disclosure relates generally to the field of electric submersible pumps (ESPs) used in subsurface wells. More specifically, the disclosure relates to methods for retrieving ESPs, including for example, ESPCPs (electrically submersible progressive cavity pumps) that have been deployed in wells at the end of an electrical cable, specifically a tubing encapsulated cable (TEC).

ESPs are known in the art to be conveyed to a selected depth in a subsurface well by connecting a TEC to the ESP and extending the TEC into the well until the ESP is at a selected depth in the well. After the ESP is disposed at the selected depth, certain equipment and procedures may be used to retain the upper end of the TEC in position, such as in a specially designed well head. A free end of the TEC passes through sealing elements in the well head. The free end of the TEC may then be cut to a desired length, and electrical connections to one or more electrical conductors in the TEC may be made to provide electric power to operate the ESP.

Should it become necessary to withdraw the ESP from the well, it is necessary to retract the TEC from the well. Ordinarily a winch would be used for such purpose; in the case of a TEC that has been cut to length at the surface there is a need to make a mechanical connection to the end of the TEC that can support the axial load of the TEC deployed in the well and the ESP connected to the end of the TEC. It is desirable that such connection be relatively short length and spoolable onto the winch to facilitate withdrawal of the TEC and ESP assembly by means of a winch. It is also desirable to have a method for retrieving an ESP from a well without the need to close or "kill" the well.

SUMMARY

In one aspect, the present disclosure relates to a splice connector for a spoolable tube. The splice connector includes a center portion having an outer diameter equal or substantially equal to an outer diameter of a tube. A longitudinal extension extends in each longitudinal direction outwardly from the center portion. The longitudinal extensions comprise a plurality of spaced apart segments having an outer diameter equal to an inner diameter of the tube and a plurality of longitudinally spaced apart crimp grooves disposed between the spaced apart segments. An inner diameter of the splice connector is selected such that when the splice connector is assembled to a tube on each longitudinal extension, the splice connector is bendable to a radius of curvature of a winch reel used to deploy and/or retrieve the tube.

In use, the longitudinal extensions of the splice connector may create a splice between two tubes. The outer diameter of the center portion may be equal or substantially similar to the outer diameter of one or both of the two tubes so that the splice and two tubes may have a substantially constant outer diameter when spliced. The splice connector is also bendable to a radius of curvature of a winch reel used to deploy and/or retrieve the tube. This configuration of splice connector may facilitate spooling of the splice connector onto a winch, for example by allowing more smooth spooling onto the winch, reducing stress concentrations in the tube and the splice connector, or the like, and may permit the retrieval of an ESP pump system under live well conditions without killing the well with fluid.

In some applications, the splice connector may be connectable to an end of a previously deployed tube, for example deployed in a well. The splice connector may enable a connected tube to be retrieved by being spooled onto a winch. The splice connector may be connectable to a tube so as to extend the length of that tube.

The plurality of spaced apart segments may be spaced so as to facilitate splicing operations with a tube. For example, the plurality of spaced apart segments may have a spacing that improves grip on the tube, while minimizing stress concentrations in the tube and/or in the splice connector.

The longitudinal extensions may be able to be inserted into a tube to enable splicing operations. The tube may be crimped on an outer surface thereof that is in the region of the crimp grooves. The tube may be crimped on an outer surface thereof that is adjacent the crimp grooves when a longitudinal extension of the splice connector is inserted into the tube.

The plurality of spaced apart components may have a spacing to facilitate the splicing operation itself. For example, the plurality of spaced apart components may be evenly spaced apart, so as to facilitate location of the crimp grooves of the splice connector when a longitudinal extension thereof is inserted into a tube.

Crimping of the tube in the region of the crimp grooves may permit an improved connection of the tube and the splice connector, for example improved grip. Crimping of the tube in the region of the crimp grooves may permit an improved connection compared to, for example, crimping of the tube in a region spaced longitudinally apart from the crimp grooves. Such an improved connection may enable a tube to better support, for example, its own weight and/or the weight of a connected component such as an ESP when suspended in a well.

The crimp grooves may have an angular profile. Such an angular profile may assist in improving the grip of the tube and splice connector.

A transition between the spaced apart segments and the crimp grooves may be substantially square.

The crimp grooves may have a depth that is a function of the thickness of the tube. Such a relationship between the thickness of the tube and the depth of the crimp grooves may permit the splice connector to more easily engage the crimped tube, and may allow the tube to be crimped without excessive deformation of the tube.

The crimp grooves may comprise or define an outer diameter smaller than the outer diameter of the segments by an amount substantially equal to a wall thickness of the tube.

The splice connector may be formed from a deformable material. The splice connector may be formed from a material that may be plastically deformed. The splice connector may be formed from a ductile metal. The splice connector may be capable of withstanding repeated bending cycles. Having a splice connector that is deformable may permit the splice connector, when crimped to a tube or tubes, to be more easily wound onto and/or from a winch. For example, the splice connector may be able to deform to have a curvature to allow it to be easily wound onto a winch. In some examples, the splice connector may be formed from at least one of titanium and alloys thereof.

In some examples, the tube may comprise a tubing encapsulated cable (TEC).

In another aspect, the present disclosure relates to a splice connector for a spoolable tube. The splice connector may include a body portion having an outer diameter equal or substantially equal to an outer diameter of a tube. A longitudinal extension may extend in a longitudinal direction outwardly from the body portion. The longitudinal extension may comprise a plurality of spaced apart segments having an outer diameter equal to an inner diameter of the tube and a plurality of longitudinally spaced apart crimp grooves disposed between the spaced apart segments. An inner diameter of the splice connector may be selected such that when the splice connector is assembled to a tube on the longitudinal extension, the splice connector is bendable to a radius of curvature of a winch reel used to deploy and/or retrieve the tube.

The splice connector may include a longitudinal extension extending in each longitudinal direction outwardly from the body portion. In this example the body portion may define a center portion. Each longitudinal extension may be configured similarly. Each longitudinal extension may facilitate connection with a respective tube.

In another aspect, the present disclosure relates to a method for retrieving an electric submersible pump (ESP) from a well deployed at the end of a tube. The method may comprise exposing a free end of the tube extending above a surface end of the well. The method may comprise inserting a longitudinal extension of a splice connector into the free end of the tube. The method may comprise crimping the tube into crimping grooves in the splice connector. The method may comprise retracting the tube with the ESP attached thereto by withdrawing the tube and splice connector onto the winch until the ESP is disposed above a wellhead at an upper end of the well.

The method may comprise removing electrical conductors contained in the tube along a longitudinal distance corresponding to a length of a longitudinal extension of a splice connector. The method may comprise removing the electrical conductors by means of drilling. For example the method may comprise drilling into an open end of the tube to remove electrical conductors contained therein. The method may comprise smoothing an internal surface of the tube. The method may comprise de-burring or honing the internal surface of the tube after drilling to remove the electrical conductors contained therein. Smoothing of the internal surface of the tube may permit the splice connector to be more easily installed, and provide better grip once installed.

The method may comprise pre-assembling the splice connector to a length of tube disposed on a winch, the longitudinal extension into the free end having the conductors removed. The method may comprise crimping the tube into crimping grooves in the splice connector. The method may comprise removing the ESP with the tube attached thereto from the well by withdrawing the tube and splice connector onto the winch until the ESP is disposed above a wellhead at the top of the well.

The method may comprise crimping the tube with a crimping device, for example a hydraulic crimping device.

The method may comprise opening a well barrier or barriers, for example opening a valve such as a master valve (MV).

In some examples, the method further comprises closing valves in a wellhead at the surface end of the well and retrieving the ESP from a lubricator coupled to the top of the wellhead. The method may comprise closing a well barrier or barriers, for example closing a valve such as a master valve (MV).

In some examples, the method may comprise making more than one crimp in the tube in each crimp groove. The method may comprise making a first crimp at each crimping groove followed by a second crimp at each crimping groove. The method may comprise rotating the second crimp by 90 degrees from the first crimp. The method may comprise making a series of crimps in a pattern. For example, the method may comprise making multiple the same number of crimps in each crimp groove. The method may comprise first making a crimp in the crimp groove located longitudinally furthest from the center portion. The method may comprise making multiple crimps, starting with making a crimp in the crimp groove furthest from the center portion. The method may comprise making a crimp in only some, i.e. not all, of the crimp grooves.

In some examples, the method further comprises reinserting the ESP into the well to a depth enabling a selected length of the tube to extend above the well head. The method may comprise securing the tube longitudinally in the wellhead. The method may comprise gripping the tube with a cable wellhead gripper. The method may comprise releasing the tube from a cable wellhead gripper. The method may comprise exposing electrical conductors in the extending tube to make electrical connection to the ESP in the well. The method may comprise stripping back a portion of the tube to expose the electrical conductors.

The method may comprise pulling the tube with an attached ESP upwards, out of a well. The method may comprise pulling the tube with an attached ESP and splice connector upwards, pulling the splice connector onto a winch or winch reel.

The method may comprise retrieving an ESP to surface of a well. The method may comprise retrieving an ESP to surface of a well by spooling tube onto a winch or winch reel over the top of the spoolable splice connector (e.g. by spooling tube onto a winch or winch reel after the spoolable splice connector has already been pulled onto the winch or winch reel).

In some examples, the method may comprise connecting a spacer between the end of the tube and the ESP, the spacer having a length selected to adjust for a length of the tube removed during the retrieval of the ESP from the well.

In a further aspect, the present disclosure relates to a method for retrieving an electric submersible pump (ESP) from a well deployed at the end of a tubing encapsulated cable (TEC). The method may comprise exposing a free end of the TEC extending above a surface end of the well. The method may comprise inserting a longitudinal extension of a splice connector into the free end of the TEC. The method may comprise crimping the TEC into crimping grooves in the splice connector. The method may comprise retracting the TEC with the ESP attached thereto by withdrawing the TEC and splice connector onto the winch until the ESP is disposed above a wellhead at an upper end of the well.

BRIEF DESCRIPTION

DETAILED DESCRIPTION

Figure 1:
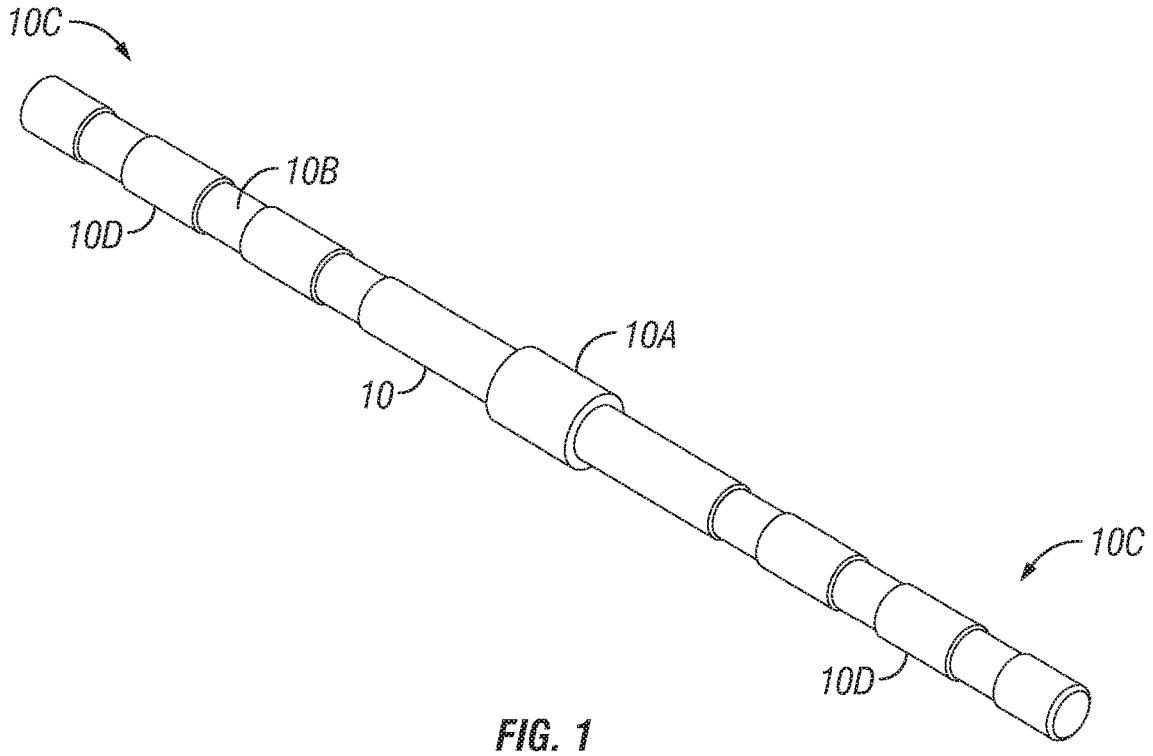
FIG. 1 shows an example of a splice connector to mechanically join two ends of a tubing encapsulated cable (TEC) or other tube.

FIG. 1 shows an example of a spoolable splice connector 10. The spoolable splice connector 10 may comprise a centrally disposed "full diameter" section 10A which has an outer diameter substantially the same as a tubing encapsulated cable (TEC, see FIG. 2) or other tube to be spliced together. A plurality of crimp grooves 10B may be disposed on longitudinal extensions 10C extending from each longitudinal end of the full diameter section 10A. The crimp grooves 10B are disposed between longitudinal segments 10D on each longitudinal extension 10C. The longitudinal segments 10D may have an outer diameter approximately the same as an internal diameter of the TEC or tube to be spliced. The crimp grooves 10B may have a depth approximately equal to the wall thickness of the TEC or other tube to be spliced. An outer diameter of the splice connector 10 may be selected such that when the splice connector 10 is assembled to two separated ends of a tube such as the jacket of a TEC, the splice connector 10 and the assembled TEC or tube ends (see 12A, 12B in FIG. 2) have a substantially constant outer diameter over the entire length of the splice. Such outer diameter may be substantially the same as the nominal outer diameter of the tube or TEC. An inner diameter of the splice connector may be selected such that when the splice connector is assembled to the tube on each longitudinal extension, the splice connector and the tube are bendable to a radius of curvature of a winch reel (see FIG. 9) used to deploy the tube in a wellbore.

In some examples, the edges of the crimp grooves 10B may have sharp (very small radius) edges to ensure sufficient axial load strength to the assembled crimp connector 10 and tube ends. In some examples, the spoolable splice connector 10 may be made from a high strength, ductile (and therefore bendable) material such as titanium and alloys thereof.

Figure 2:
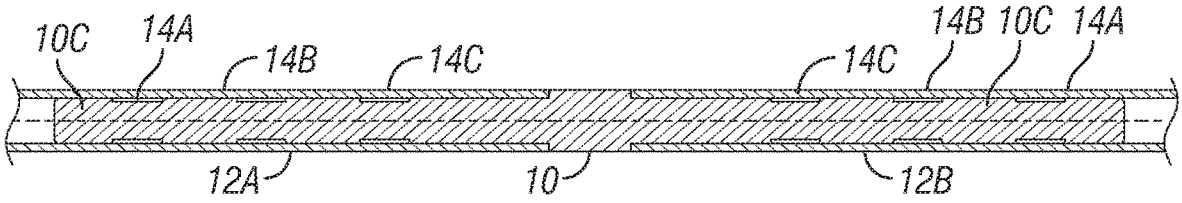
FIG. 2 shows the splice connector of FIG. 1 assembled to two ends of a TEC.

FIG. 2 shows an example of a splice connector 10 having its two longitudinal extensions 10C in FIG. 1 disposed in open ends 12A, 12B of a TEC or other tube to be spliced together. Example longitudinal positions for crimping the tube at its separate longitudinal ends 12A and 12B are shown at 14A, 14B, and 14C.

Figure 3:
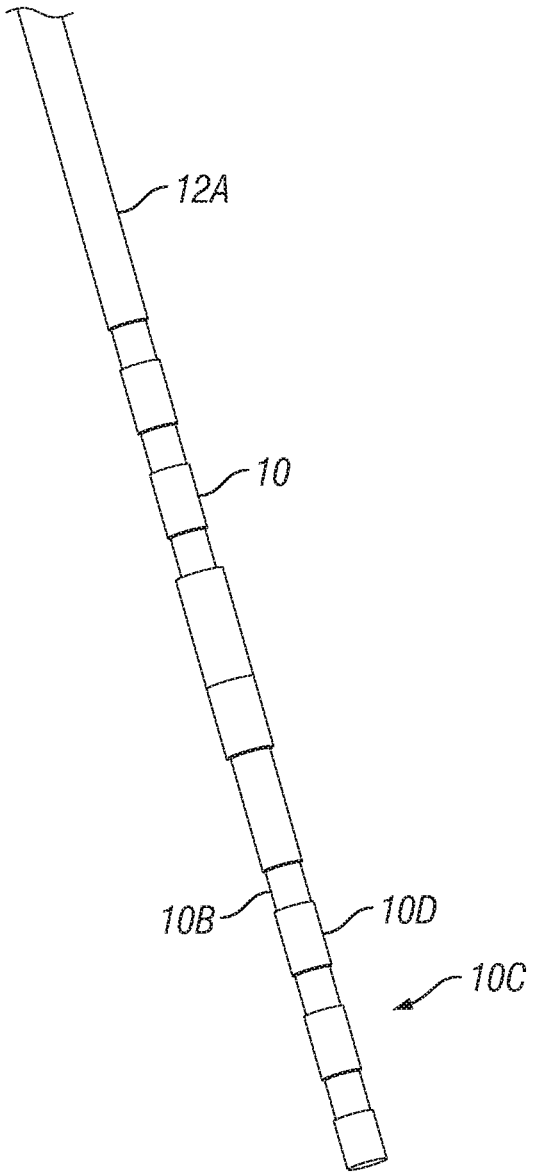
FIG. 3 shows the splice connector attached to an end of a TEC spooled on a winch.

In some examples, a service vehicle or other supporting platform having a winch thereon may have spoolable TEC or other spoolable tube (e.g., coiled tubing) on the winch prior to commencement of ESP retrieval operations. FIG. 3 shows an example of a splice connector 10 already crimped onto a free end of a TEC or tube extending from a winch (see FIG. 9). One of the longitudinal extensions (10C in FIG. 1) is already disposed inside the end 12A of the tubing or TEC substantially as shown in FIG. 2. The other longitudinal extension 10C of the splice connector 10 is exposed, showing the longitudinal segments 10D and crimp grooves 10B substantially as explained with reference to FIG. 1.

Figure 4:
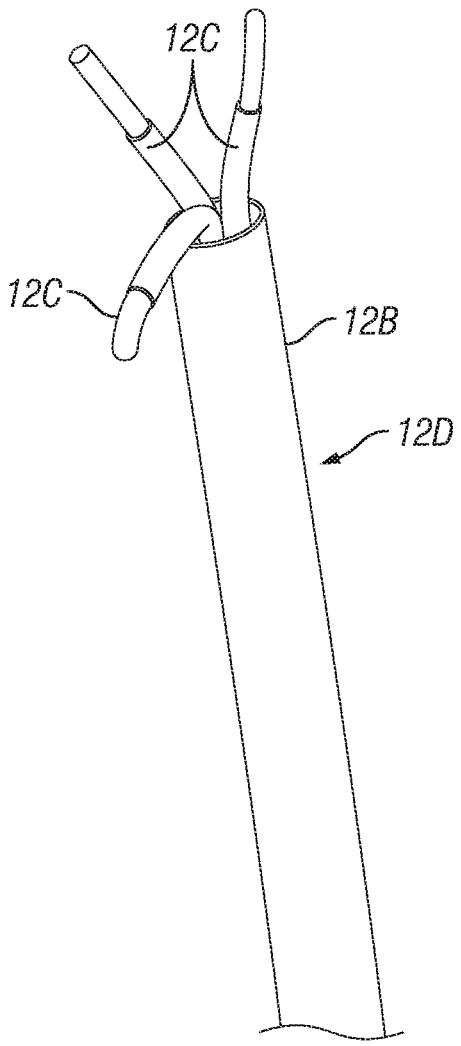
FIG. 4 shows the upper end of a cut to length TEC as it may protrude from a well head.

FIG. 4 shows the other end 12B (e.g., the end of the TEC protruding from the well head) or other tube to be spliced by coupling to the splice connector (10 in FIG. 3). The other end 12B in the present example is an end of a TEC and comprises electrical conductors 12C, a longitudinal portion of which will be removed prior to splicing the other end 12B to the splice connector (10 in FIG. 3). Removing the longitudinal portion of the electrical conductors 12C in a TEC may be performed using a drill or similar tool. In some examples, the drill may comprise a bit having a hardness sufficient to cut through copper or aluminum electrical conductors and plastic or other insulation surrounding the electrical conductors 12C but not sufficiently hard to readily drill through the encapsulating tube 12D. In some examples, the length of the electrical conductors to be removed is approximately the same as the length of the longitudinal extension (10C in FIG. 3) of the splice connector 10.

Figure 5:
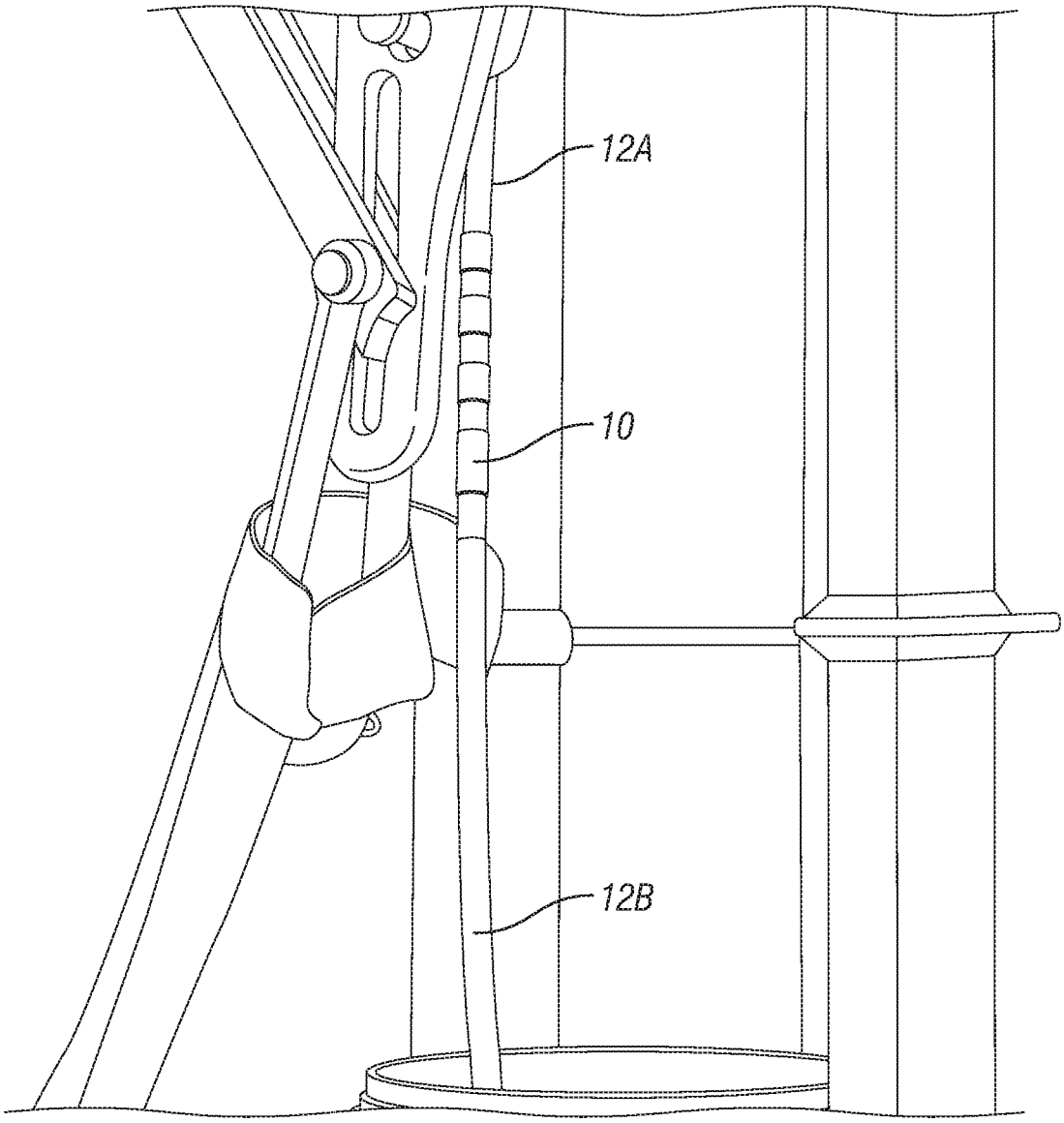
FIG. 5 shows the splice connector being inserted into a prepared end of the TEC protruding from the well head.
Figure 6:
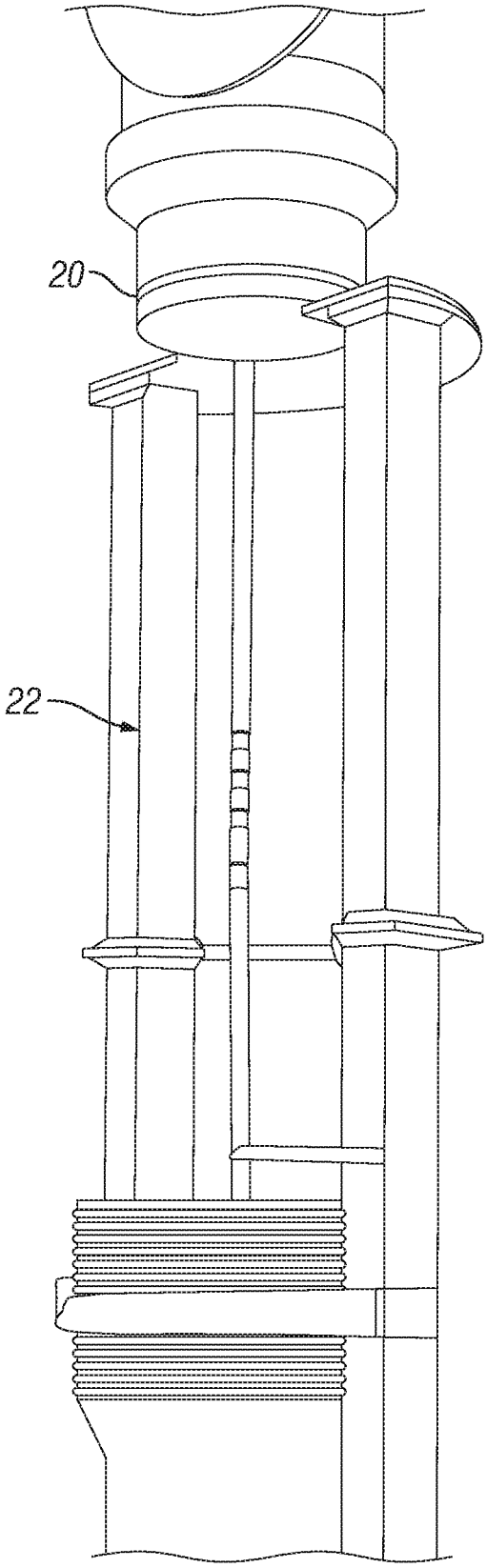
FIG. 6 shows the same view as FIG. 5 with mode detail as to a safe working area below a "lubricator" conduit.

FIG. 5 shows the splice connector 10 inserted into the free end 12B of the TEC protruding from the well head after the electrical conductors have been drilled out and the interior surface of the TEC has been smoothed, such as by deburring or honing. FIG. 6 shows the same view as FIG. 5 with more detail as to a safe working 22 area below a "lubricator" conduit 20 that has been raised above the well head (not shown in FIG. 6).

Figure 7:
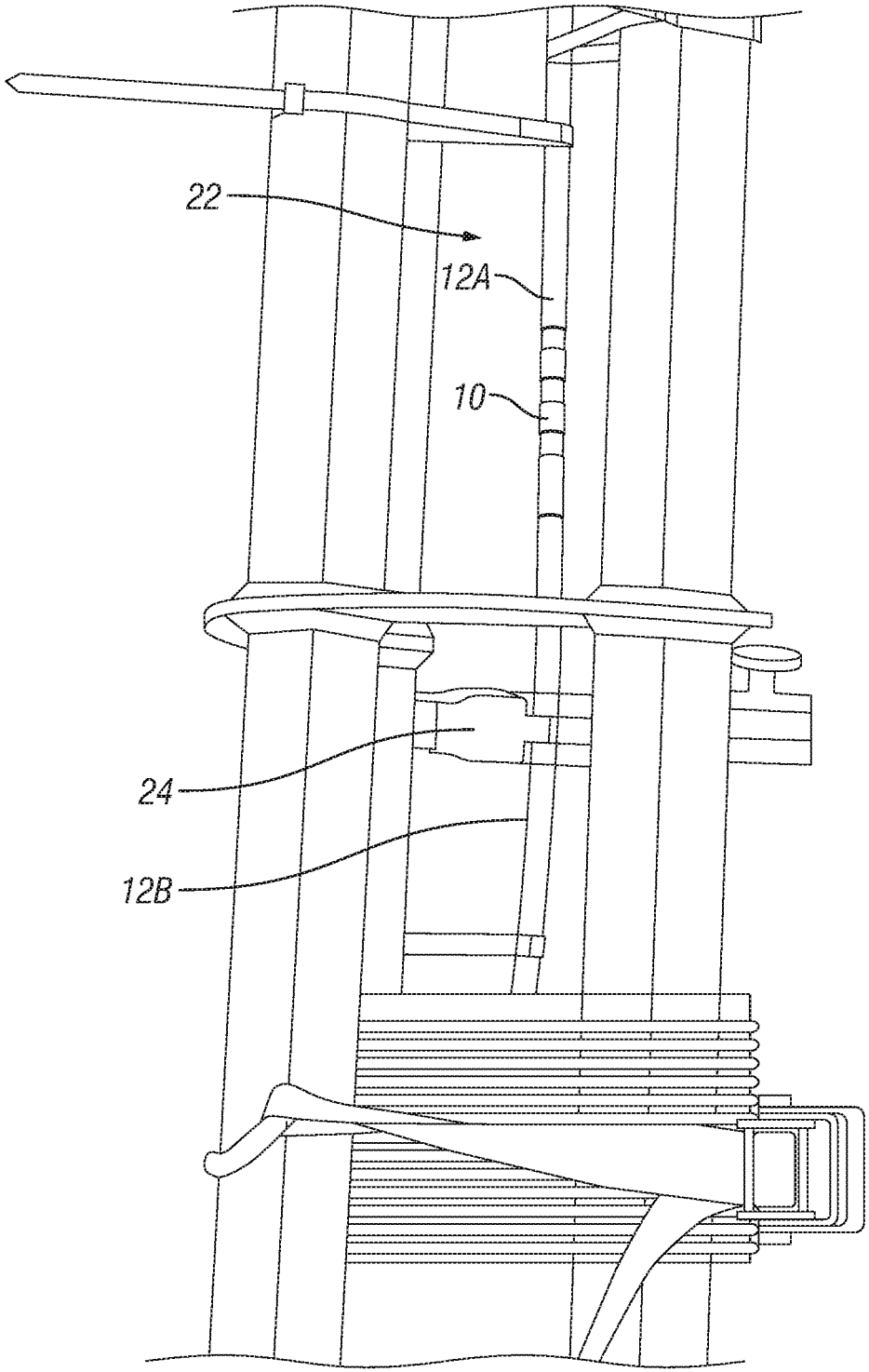
FIG. 7 shows using a crimping tool to attach the splice connector to the well head end of the TEC.

FIG. 7 shows using an hydraulic crimping tool 24 to crimp the tube end 12B into the crimp grooves (10B in FIG. 1) on the longitudinal extension (10C in FIG. 2) of the splice connector 10. In the present example, a full circumference crimp is not required. In some examples, a crimp pattern may be arranged such that for each crimp groove (10B in FIG. 1), a first crimp is made in the tube or TEC end 12B, followed by a second crimp made in the same crimp groove (10B in FIG. 1) oriented 90 degrees rotated with respect to the previous crimp in that same crimp groove. Thus, in the example of the splice connector shown in FIG. 1, in which there are three crimp grooves (10B in FIG. 1) on each longitudinal extension (10C in FIG. 1), a total of twelve individual crimps may be made in the TEC tube or other tube. In some examples, the crimp procedure may begin at the longitudinally most distant crimp groove (10B in FIG. 1) from the full diameter section (10A in FIG. 1) successively inwardly toward the full diameter section (10A in FIG. 1) to yield tube material up against the shoulder of the full diameter section (10A in FIG. 1).

Figure 8:
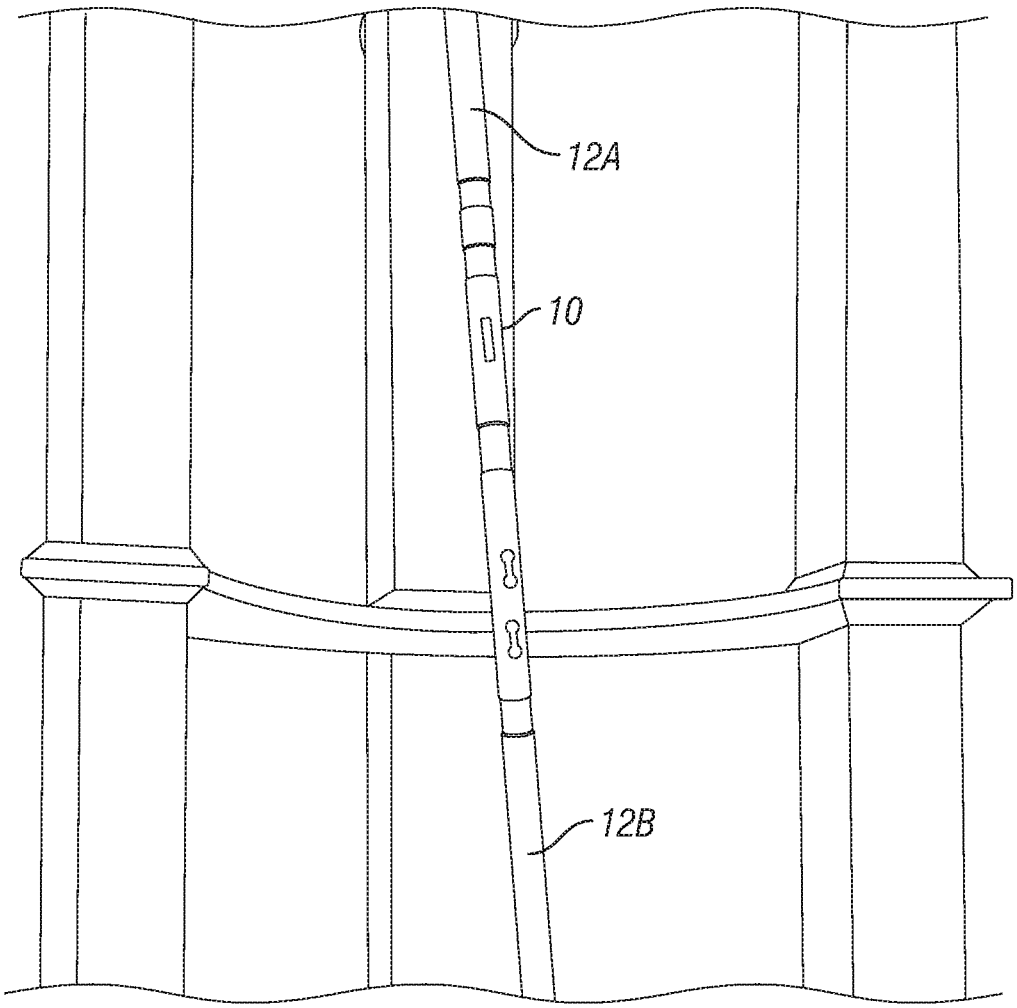
FIG. 8 shows a completed splice.

FIG. 8 shows the finished splice connection suspended above the well head. The completed splice includes the end of the tube 12A disposed on the winch (FIG. 9), the splice connector 10 and the well end of the tube 12B coupled together to form a splice having a substantially constant outer diameter along the entire length of the splice.

Figure 9:
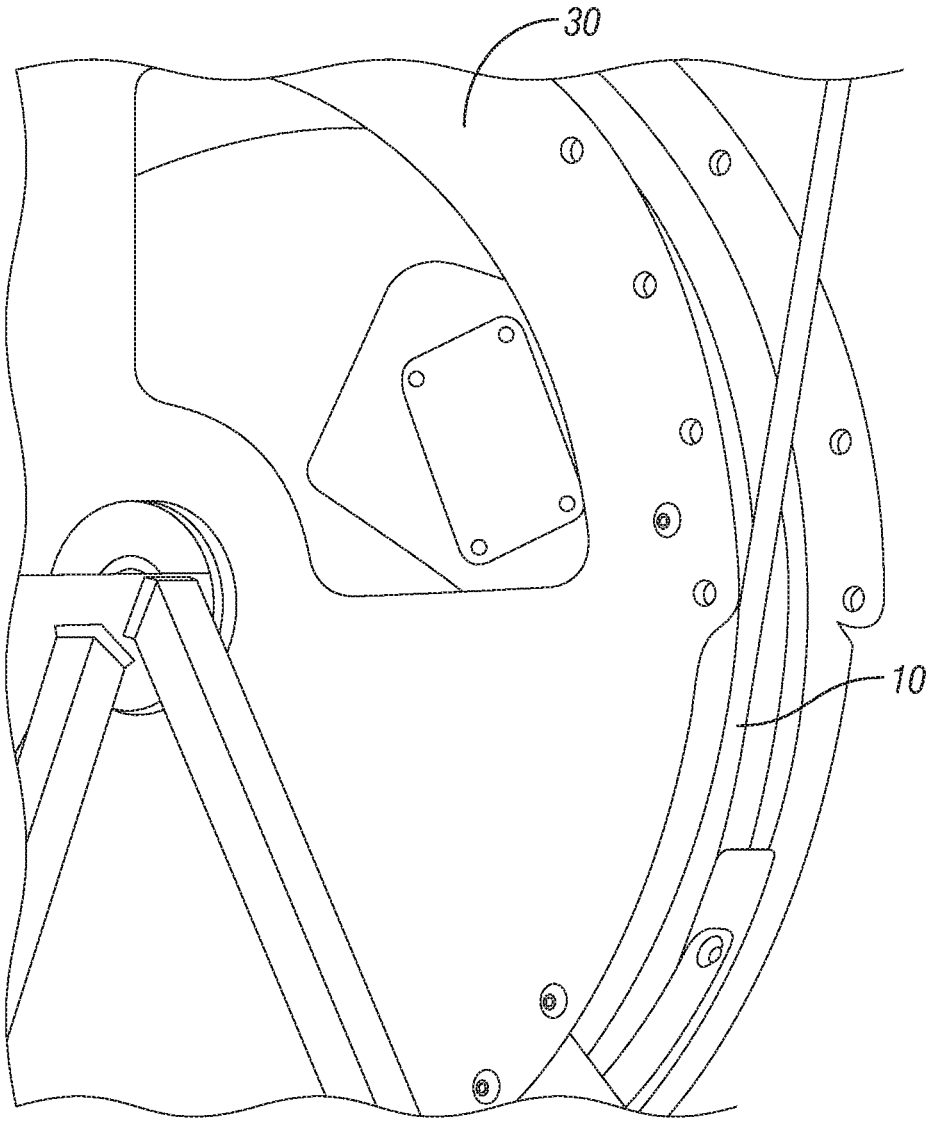
FIG. 9 shows the spoolable splice connector disposed on a winch reel as the TEC is withdrawn from the well.

FIG. 9 shows the splice connector 10 after the winch 30 has been operated to retract some of the TEC from the well. During ESP retrieval operations, the winch 30 may be operated to retract the TEC or tube from the well until the ESP is fully withdrawn from the well.

A tubing encapsulated cable (mechanical) splice according to the present disclosure can withstand repeated plastic bending deformation cycles without low cycle fatigue failure within the required service life of the TEC, which includes bending around two sheaves and one winch reel (see 30 in FIG. 9) for retrieval of the ESP system back to surface. The splice connection 10 can retain the full tensile strength of unspliced portions of the TEC or other tube. The outer diameter of the completed splice is smooth and is substantially the same as the TEC or other tube.

The splice connector features sharp edged grooves to "bite" into the TEC or other tube. In some examples, reuse of cable, for example, TEC, that has been cut/terminated/spliced for retrieval as explained above may be facilitated by use of a spacer bar inserted into the ESP equivalent in length to the length of cable (e.g., TEC) cut out at surface during the above-described re-termination process. A TEC splicing system as described herein may work in combination with a modified rod lock blowout preventer (BOP) system for gripping and sealing on the cable at the wellhead.

Figure 10:
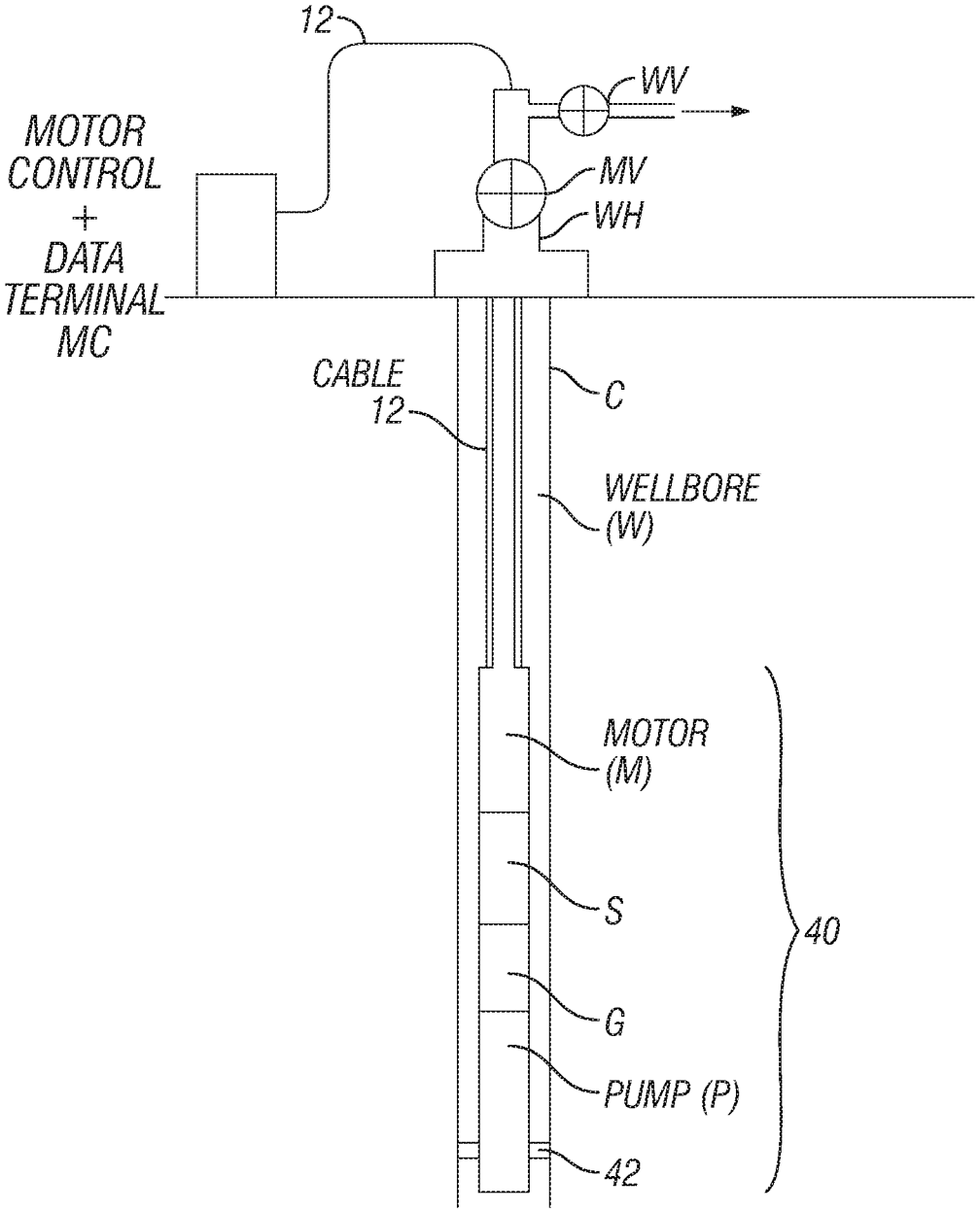
FIG. 10 shows an example deployment of an ESP on the end of a TEC.

FIG. 10 shows an elevational view of an example of an ESP 40 attached to a tube 12 such as a TEC. The ESP 40 and tube 12 are disposed in a wellbore W which is drilled through subsurface formations for the production of fluids such as water and/or petroleum. The ESP 40 may comprise a motor M, a shroud S, a gearbox and drivetrain assembly G and a pump P such as a centrifugal pump. The ESP 40 may be retained in place in the wellbore W and sealed using an annular seal 42 such as a packer positioned in a wellbore casing C at a selected depth in the wellbore W.

As used herein, the term "petroleum" refers broadly to all mineral hydrocarbons, such as crude oil, gas and combinations of oil and gas. The tube 12 connects the electric submersible pumping system 40 to a well head WH located at the surface.

Fluid emerging from the wellbore W may pass through a "wing" valve WV forming part of the wellhead WH and thence delivered to suitable produced fluid processing equipment (not shown). To close the well, a master valve MV may be included in the well head WH. Although the electric submersible pumping system 40 is designed to pump petroleum products, it will be understood that the present example of a pumping system can also be used to move other fluids, for example and without limitation, water.

The motor M may be an electric motor that receives power from a surface-mounted motor control unit MC through the TEC 12. When energized by the motor control unit MC, the motor M drives the pump P.

An example of a splice installation and ESP removal procedure may include the following:

a) open well barriers, e.g., valves such as master valve MV;
b) strip back connections to bare cable (TEC) 12 and conductors (12C in FIG. 4)
c) drill out conductors (12C in FIG. 4) within the TEC 12 to a selected length;
d) de burr ID and OD of the TEC tube;
e) shoulder the splice connector (10 in FIG. 1) to the edge of the drilled out TEC (12B in FIG. 4), and mark crimping positions;
f) push the splice connector (10 in FIG. 1) into the end of the TEC tube (12B in FIG. 4);
g) use an hydraulic crimping tool (24 in FIG. 7) to crimp in first position (outer, see 14C in FIG. 2), rotate the hydraulic crimping tool 90 degrees and crimp once again in the same crimp position;
h) repeat crimp procedure in (g) at the second position (middle, see 14B in FIG. 2);
i) repeat crimp procedure in (g) in the third position (inner, see 14A in FIG. 2);
k) close the well such as by operating master valve MV;
l) pull test the splice connection such as by rotating the winch (30 in FIG. 9);
m) release a cable wellhead gripper (not shown);
n) begin pulling the TEC with ESP system attached upward, pulling the splice connector (10 in FIG. 1) through the packing glands on the lubricator (20 in FIG. 6), over sheaves, and back to the winch reel (30 in FIG. 9);
o) retrieve the ESP 40 to surface by continuing to spool TEC onto the winch reel (30 in FIG. 9) over the top of the spoolable splice connector;
p) close well such as by operating master valve MV, open the lubricator (20 in FIG. 6).

Reinstallation of the ESP 40 may be performed by reversing the above procedure and removing the splice connector (10 in FIG. 1) from the exposed end of the TEC after the ESP 40 is fully disposed in the wellbore W.

Possible benefits of a method and system as described herein may include, without limitation, enabling retrieving an ESP pump system under live well conditions (avoid killing the well with fluid) pulling cable under combined tension and bending through a dynamic seal (pack off) and around sheave wheels back to the winch.

Although only a few examples have been described in detail above, those skilled in the art will readily appreciate that many modifications are possible in the examples. Accordingly, all such modifications are intended to be included within the scope of this disclosure as defined in the following claims.

The invention claimed is:

1. A method for retrieving an electric submersible pump (ESP) from a well where the ESP is deployed at one end of a tubing encapsulated electrical cable (TEC), comprising:

exposing a free end of the TEC extending above a surface end of the well;

drilling out electrical conductors in the TEC for a longitudinal distance corresponding to a length of a first longitudinal extension of a splice connector;

inserting the first longitudinal extension of the splice connector into the free end of the TEC, the splice connector having a completely solid filled, impermeable cross-section wherein the splice connector is bendable so as to be spoolable onto a winch which contains a length of the TEC, the splice connector comprising a center portion having an outer diameter equal to an outer diameter of the TEC, the splice connector comprising the first longitudinal extension extending in one direction and a second longitudinal extension extending in an opposed longitudinal direction outwardly from the center portion, the first and second longitudinal extensions each comprising a plurality of spaced apart segments having an outer diameter equal to an inner diameter of the tube and a plurality of longitudinally spaced apart crimp grooves disposed between the spaced apart segments wherein a transition between the spaced apart segments and each of the crimp grooves is square;

crimping the TEC into the crimp grooves in the splice connector; and retracting the TEC with the ESP attached thereto by withdrawing the TEC and splice connector onto the winch until the ESP is disposed above a wellhead at an upper end of the well.

2. The method of claim 1 further comprising reinserting the ESP into the well to a depth enabling a selected length of the TEC to extend above the wellhead;

securing the TEC longitudinally in the wellhead; and exposing the electrical conductors in the extended TEC to make electrical connection to the ESP in the well.

3. The method of claim 2 wherein a spacer is connected between the end of the TEC and the ESP, the spacer having a length selected to adjust for a length of the TEC removed during the retrieval of the ESP from the well.

4. The method of claim 1, wherein the crimping comprises making a first crimp at each crimping groove followed by a second crimp at each crimp groove rotated 90 degrees from the first crimp.

5. The method of claim 4 wherein the splice connector is formed from at least one of titanium and alloys thereof.

6. The method of claim 1, further comprising closing a valve in the wellhead; and retrieving the ESP from a lubricator coupled to the wellhead.

7. The method of claim 1, wherein the crimp grooves comprise an outer diameter smaller than the outer diameter of the segments by an amount equal to a wall thickness of the TEC.

8. The method of claim 1 wherein the splice connector is pre-assembled to the length of the TEC disposed on the winch.

* * * * *